United States Patent [19]

Fosella

[11] Patent Number: 5,067,376

[45] Date of Patent: Nov. 26, 1991

[54] ADJUSTABLE EXTENSION WRENCH FOR RATCHET DRIVE

[76] Inventor: Gregory Fosella, 97 Main St., Osterville, Mass. 02655

[21] Appl. No.: 392,206

[22] Filed: Aug. 10, 1989

[51] Int. Cl.[5] ..... B25B 13/32

[52] U.S. Cl. ..... 81/115; 81/186; 279/107

[58] Field of Search ..... 81/90.2, 90.7, 90.9, 81/112, 115, 117, 186; 279/35, 55, 71, 107, 123

[56] References Cited

U.S. PATENT DOCUMENTS

| | | | |
|---|---|---|---|
| 346,310 | 7/1886 | O'Neill | 279/107 |
| 581,427 | 4/1897 | Olson | 81/115 X |
| 877,773 | 1/1908 | Holm . | |
| 1,243,300 | 10/1917 | Jacoby | 81/115 X |
| 1,291,421 | 1/1919 | Coulter | 81/115 |
| 1,410,080 | 3/1922 | Schwahlen | 81/115 X |
| 1,450,641 | 4/1923 | Ograbisz . | |
| 1,844,616 | 2/1932 | Whiton | 81/186 X |
| 2,580,247 | 12/1951 | Secondi et al. . | |
| 3,377,893 | 4/1968 | Shorb . | |
| 3,664,213 | 5/1972 | Anati . | |

FOREIGN PATENT DOCUMENTS

| | | | |
|---|---|---|---|
| 610467 | 12/1960 | Canada | 289/123 |

*Primary Examiner*—James G. Smith

*Attorney, Agent, or Firm*—Wolf, Greenfield & Sacks

[57] ABSTRACT

An adjustable wrench has a drive shaft adapted to be turned by a conventional ratchet wrench. A housing is mounted on the output end of the shaft and three equidistantly spaced jaws are mounted between the shaft and surrounding housing. Cam surfaces are on the jaws and inside of the housing so that housing rotation in one direction will open the jaws and in the other direction will close them. A ratchet mechanism connects the shaft to the housing.

16 Claims, 8 Drawing Sheets

ADJUSTABLE EXTENSION WRENCH FOR RATCHET DRIVE

INTRODUCTION

This invention relates to extension wrenches and more particularly comprises a new and improved adjustable extension wrench designed for use with ratchet drives.

Most of the extension wrenches used today either have a single fixed working head that fits one size nut or bolt, or has interchangeable heads each of a different size to cover the desired range. There are approximately 23 standard and 18 metric heads typically available for extension wrenches within the range of from 5/16 to 1 inch in diameter which creates an inventory of 41 different pieces.

The principle object of the present invention is to provide a single extension wrench which is adjustable so as to cover a full range of popular size nuts and bolts 5/16 inch to 1 inch, including all of the standard and metric sizes within that range.

Another important object of the present invention is to provide an adjustable extension wrench capable of accommodating a substantial range of nut and bolt sizes but which is only slightly larger than the largest head a nut or bolt it is designed to accommodate.

Another important object of the present invention is to provide an adjustable extension wrench which is very simple and convenient to operate.

Yet another important object of this invention is to provide an adjustable extension wrench having moveable jaws which automatically lock in fixed position when they are tightened onto a workpiece so as not to slip on or strip the workpiece faces engaged by the jaws.

Still another important object of the present invention is to provide an adjustable extension wrench having gripping faces that are self-adjusting so as to maintain a parallel relationship with the faces of the workpiece to be engaged by them.

To accomplish these and other objects, the adjustable extension wrench of the present invention has a central shaft having an input and an output end. A housing in the form of a sleeve is rotatably mounted on the shaft at its output end, and three equidistantly spaced jaws are captured between the shaft and housing and are biased apart by springs. Cam surfaces on the jaws and housing cooperate to move the jaws toward one another when the housing is turned in one direction and allow the jaws to move away from one another under the bias of the springs when the housing is rotated in the opposite direction. Gripper pads are carried by each of the jaw and are independently moveable on them. The gripper pads are self-adjusting so that their gripping faces are square to the faces to be engaged on the workpiece regardless of the size of the workpiece.

Above the housing on the shaft is a ratchet mechanism having a conveniently located control lever which locks and unlocks the housing with respect to the shaft and allows it to rotate with respect to the shaft in either direction so as to close or open the jaws.

These and other objects and features of the present invention will be better understood and appreciated from the following detailed description read in connection with the accompanying drawings.

BRIEF FIGURE DESCRIPTION

Figure 2:
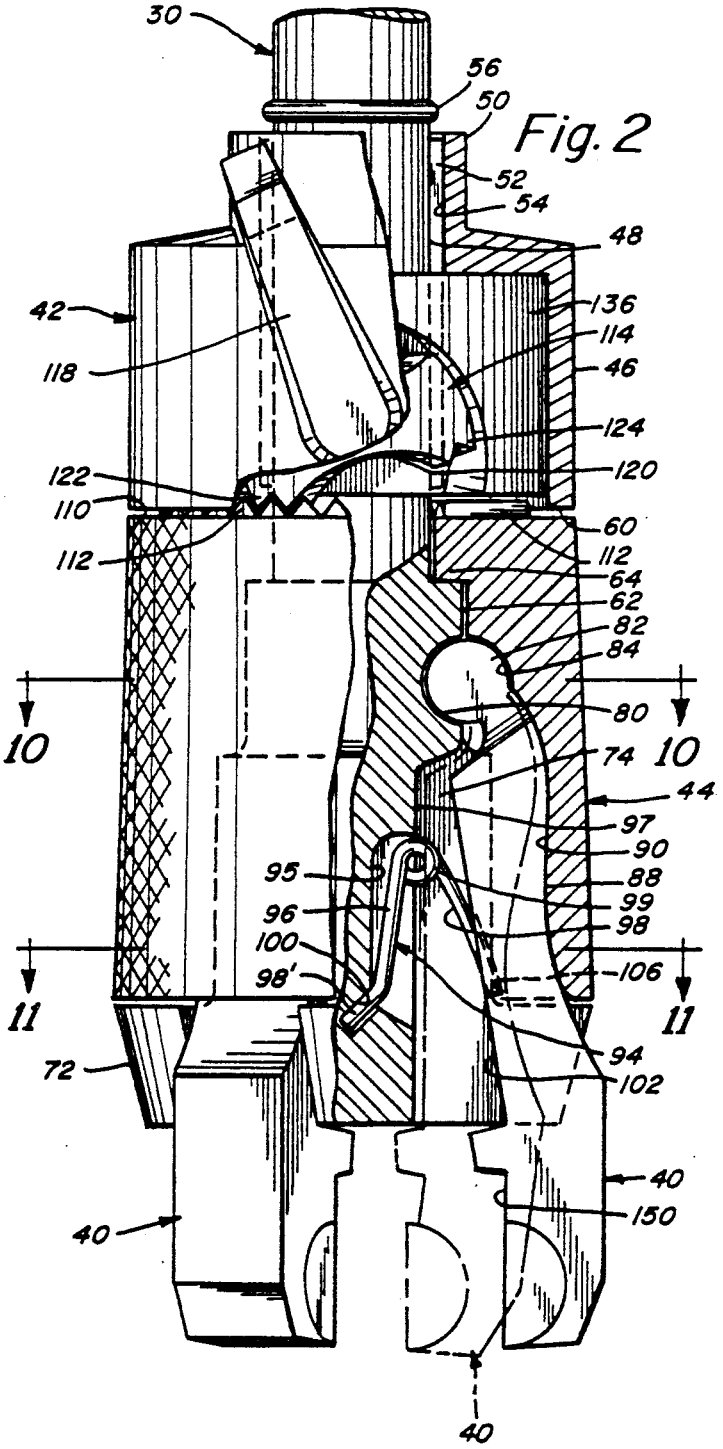
FIG. 2 is a enlarged fragmentary cross-sectional view of the output end of the wrench shown in FIG. 1.
Figure 7:
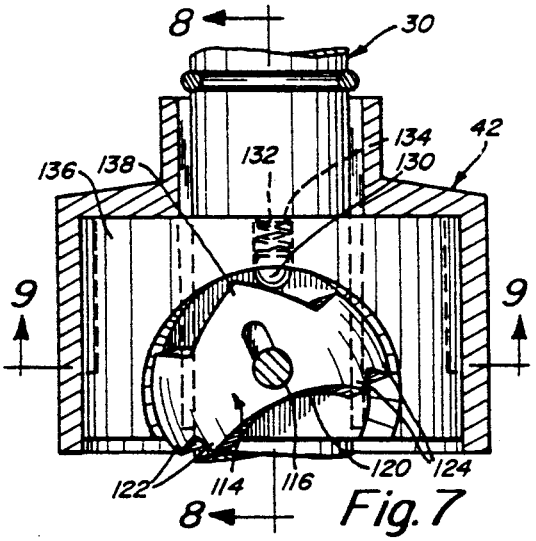
FIG. 7 is a fragmentary cross-sectional view of the upper portion of the output end of the wrench showing details of the ratchet mechanism.
Figure 8:
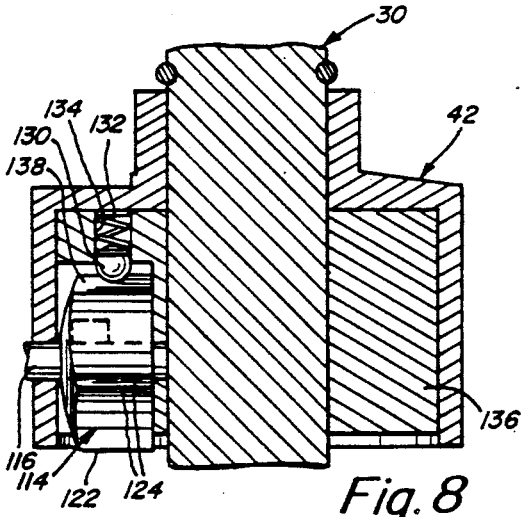
Figure 9:
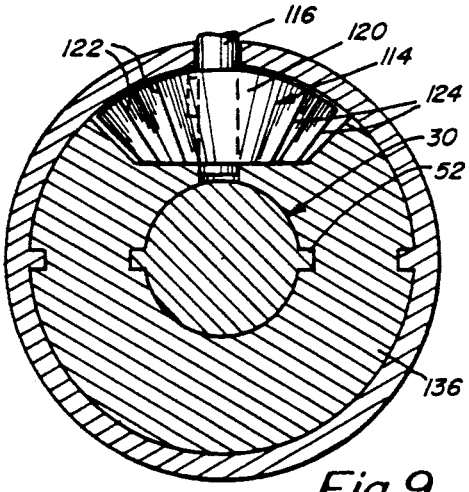
Figure 10:
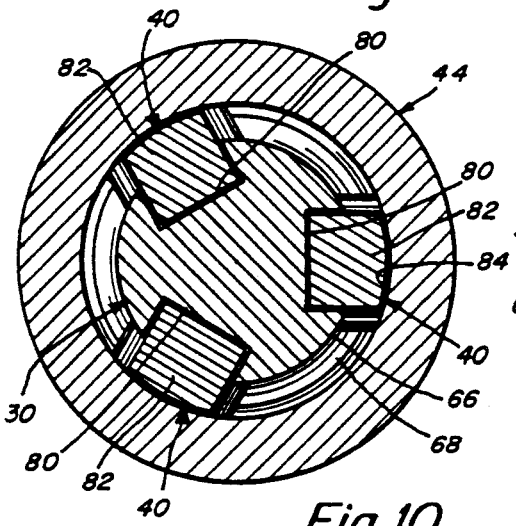
Figure 11:
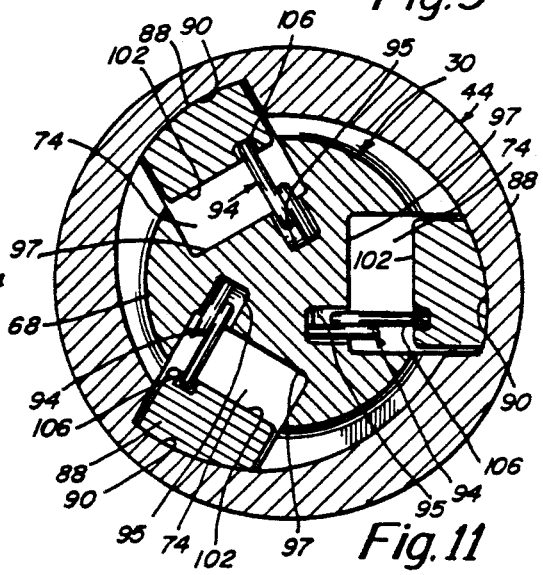
Figure 16:
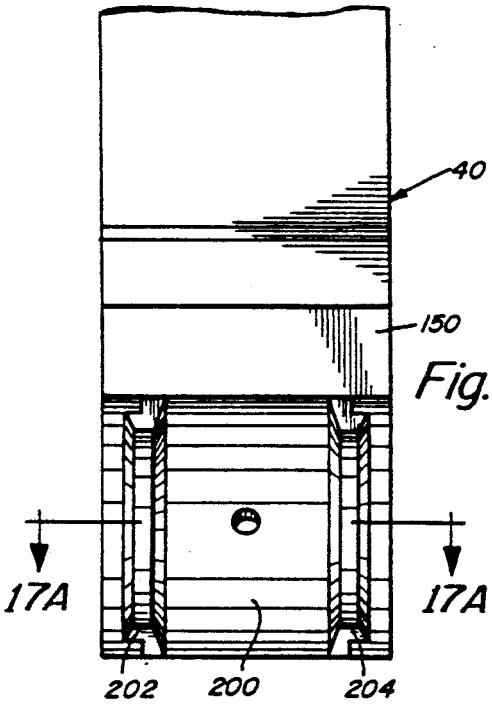
Figure 17:
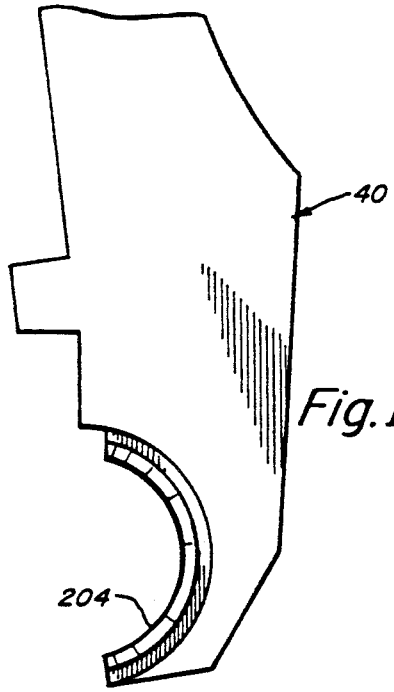
Figure 17A:
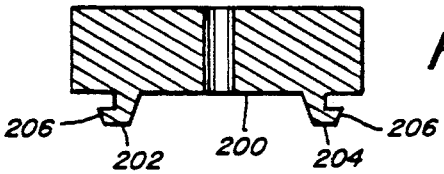

FIG. 8 and 9 are is a cross-sectional views taken along the section lines 8—8 and 9—9 in FIG. 7;

FIGS. 10 and 11 are cross-sectional views taken along the sectional lines 10—10 and 11—11 in FIG. 2;

FIGS. 12-15 are diagrammatic views showing various positions of one of the jaw assemblies of the wrench engaging nuts of progressively larger size;

FIG. 16 is an enlarged detailed view of the inner face of the working end of the jaw;

FIG. 17 is a detailed side view of the working end of the jaw shown in FIG. 16;

FIG. 17A is a cross-sectional view of a jaw taken along section line 17A—17A of FIG. 16.

Figure 18:
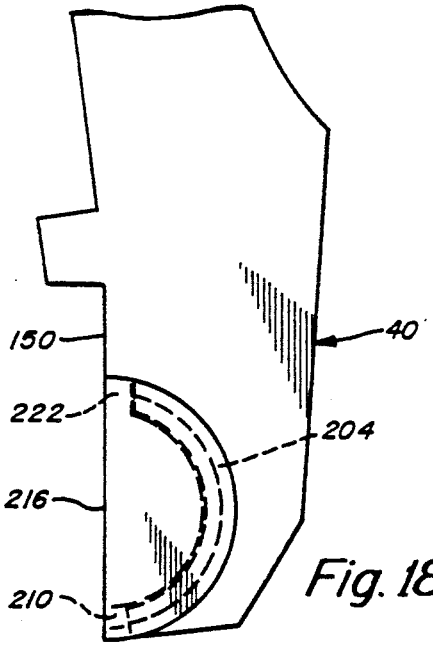
Figure 18A:
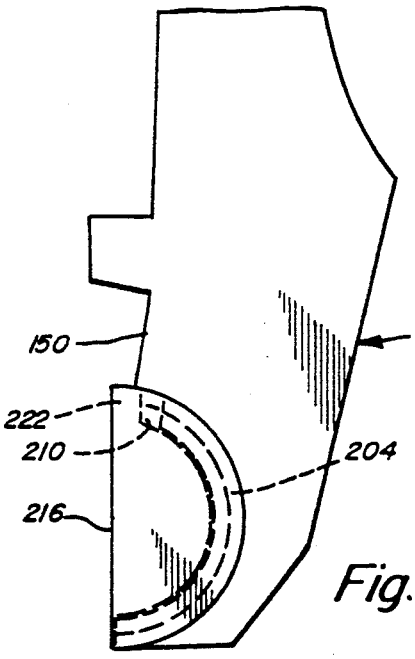
Figure 19:
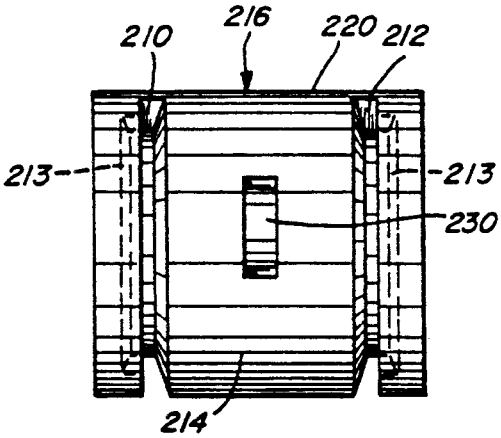
Figure 20:
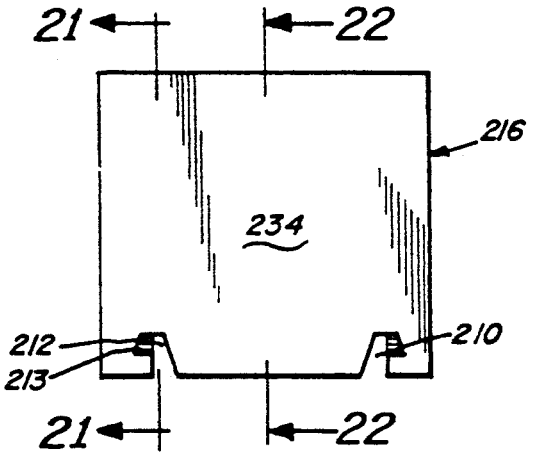
Figure 21:
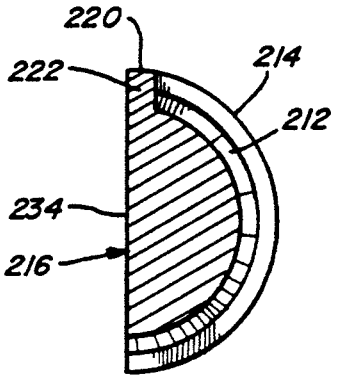
Figure 22:
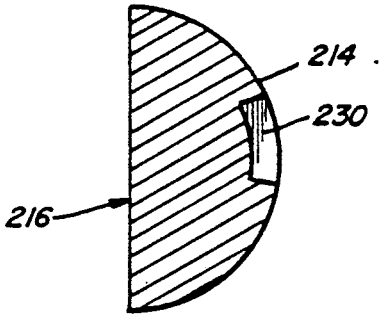
Figure 23:
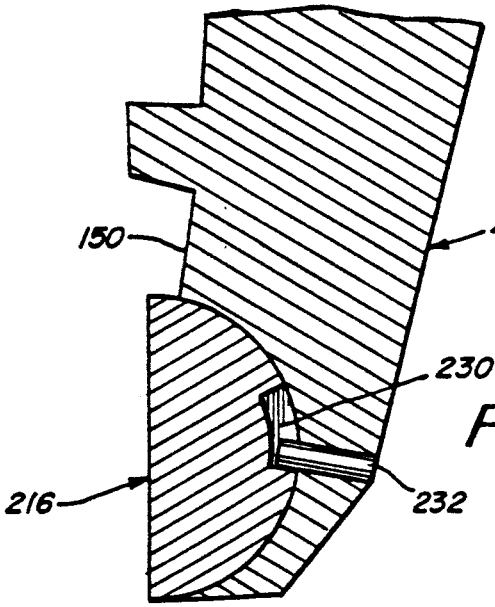
Figure 24:
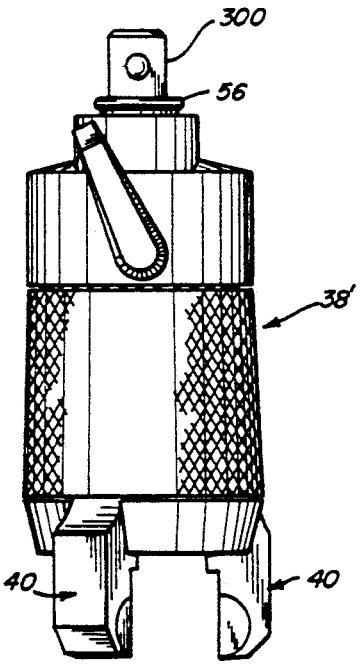
Figure 25:
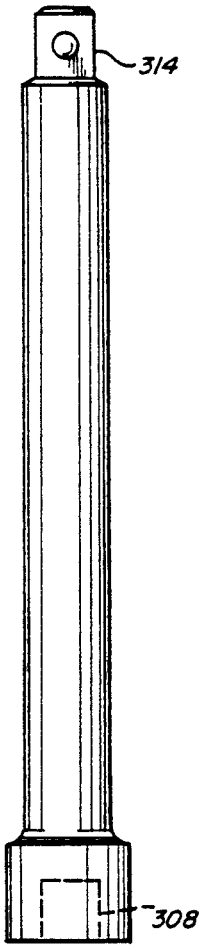
Figure 26:
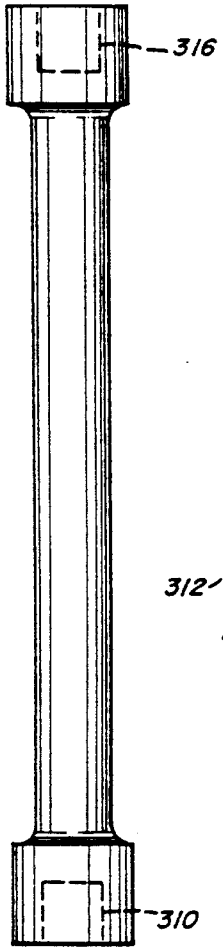
Figure 27:
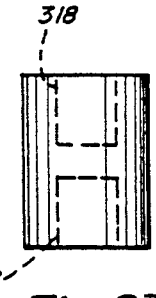
Figure 28:
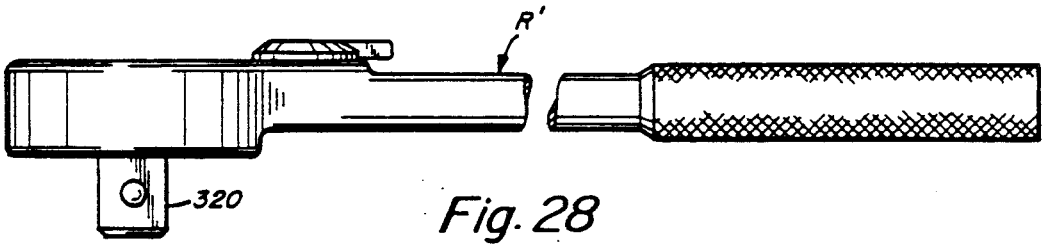
Figure 29:
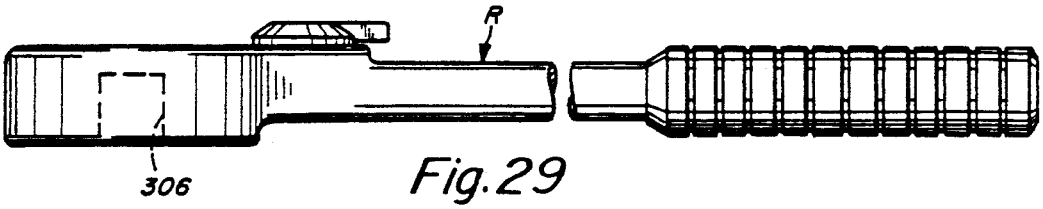

FIG. 18 is a detailed view similar to FIG. 17 but showing a gripper pad mounted on the jaw to form the jaw assembly;

FIG. **18*a* is a view similar to FIG. 18** but showing the gripping pad in an alternate position on the jaw;

FIG. 19 is a rear elevation view of the gripper pad;

FIG. 20 is a front elevation view of the gripper pad shown in FIG. 19;

FIGS. 21 and 22 are cross-sectional views of the gripper pad taken along the section lines 21—21 and 22—22 in FIG. 20;

FIG. 23 is a cross-sectional view of the jaw assembly similar to FIG. 18A but taken along the line of the assembly;

FIG. 24 is a side elevation view of the output end of a second embodiment of the invention particularly designed for use in a modular system;

FIGS. 25 and 26 are elevation views of two different extension bars that may be used with the embodiment of FIG. 24;

FIG. 27 is an elevation view of an adapter for use with the embodiment of FIG. 24;

FIG. 28 is a side view of standard square head ratchet wrench that may be used to drive the embodiment of FIG. 24 either with the extension bar of FIG. 26 or adapter of FIG. 27; and FIG. 29 is a side view of another form of ratchet wrench that may be used to drive the embodiment of FIG. 24 through the extension bar of FIG. 25.

DETAILED DESCRIPTION OF THE DRAWING

The adjustable extension wrench of this invention is assembled on a shaft 30 having input and output ends 32 and 34 respectively. The input end 32 of the shaft carries a standard square drive fitting 36 which is adapted to be engaged by a drive tool such as a ratchet, socket wrench or open wrench etc. to rotate the shaft.

The output end 34 of the shaft 30 carries a working head 38 having a plurality of adjustable jaws 40 circumferentially spaced about the shaft axis and that may be moved in and out with respect to the axis to engage and release a wide range of sizes of nuts and bolts to be turned by the tool. In the embodiment shown, three jaws 40 are provided spaced 120° apart and intended to engage hexagonal nuts or bolt heads.

Figure 6:
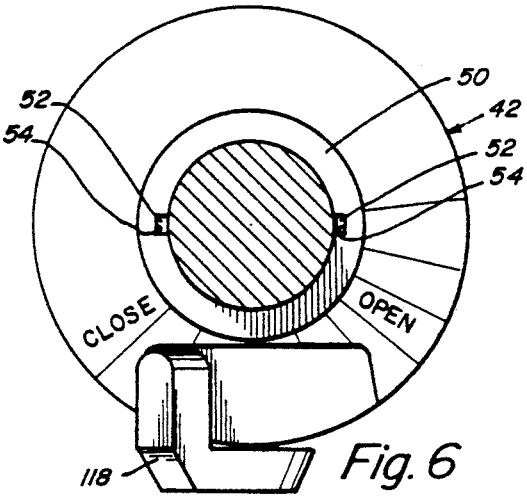
FIG. 6 is a cross-sectional view of the output end of the wrench taken along the section line 6—6 in FIG. 1.

The working head 38 of the tool includes a ratchet housing 42 and a jaw assembly housing 44 aligned axially on the output end of shaft 30. The ratchet housing 42 has a cylindrical skirt 46 spaced from the outer surface 48 of shaft 30 and a collar 50 which is keyed to the shaft so that the housing 42 rotates with it. The shaft and ratchet housing are keyed together by the ribs 52 carried by the shaft, which register with the recesses 54 provided in the collar 50 (see FIG. 6). A retaining ring 56 mounted on shaft 30 just above the collar in a shallow recess retains the housing 42 in position.

The output end 34 of shaft 30 extends axially through and beyond the lower end of the ratchet housing 42 as is clearly shown in FIG. 2. The lower end of the shaft which extends beyond the lower end of the skirt 46 is shown in detail in FIGS. 2, 4, 5, 10 and 11. The shaft 30, just below the lower end 60 of skirt 46, has a shoulder 62 on which the inner edge 64 of the jaw assembly housing 44 is supported. Beneath the shoulder 62 the shaft maintains a uniform diameter along section 66, and the diameter of the shaft 30 is enlarged along section 68. The lower end 70 of the shaft 30 has an outwardly extending flange 72 which closes the lower end of jaw assembly housing 44.

Three axially extending recesses 74 are provided in the surface of shaft 30 on the sections 66 and 68. Each recess receives one of the adjustable jaws 40. The recesses 74 along with the special contour of the inner surface of jaw housing 44 cooperate to retain the adjustable jaws in place. Recesses 74 also prevent the jaws from racking or twisting when they are stressed by the action of tightening or loosening the nut or bolt. The upper end of each recess 74 in section 66 of shaft 30 has a semi-cylindrical well 80 which receives the cylindrical head 82 of a jaw 40. An arcuate surface 84 on the inside of jaw housing 44 and of the same radius as the semi-cylindrical well 80 extends about approximately 110° of the cylindrical head 82 as a continuation of the well 80, and the two curved surfaces together define a pivot recess that retains the head 82 in place. The head supports the jaw 40 for pivotal motion between the outermost position suggested in full lines and the innermost position suggested in broken lines in that FIG. 2. As is explained in greater detail below, the outer curved surface 88 of the jaw 40 disposed opposite section 68 of shaft 30 cooperates with the cam surface 90 formed on the inside of the jaw housing 44 to control the position of each jaw. This relationship is clearly shown in FIG. 11.

Figure 5:
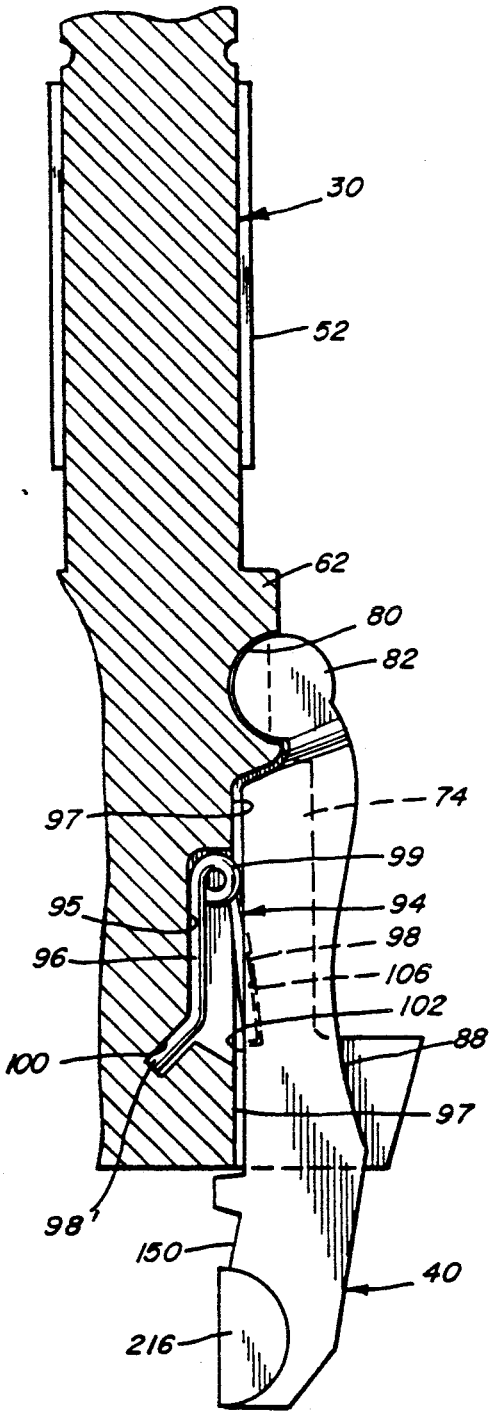
FIG. 5 is a side elevation view of the detail of FIG. 4.

A Sear spring 94 having arms 96 and 98 and a coiled head 99 is mounted in a trough 95 formed in the inner wall 97 of the recess 74. The lower end 98' of the spring arm 96 registers with a slot 100 formed at the bottom of the trough to hold the spring in place. The spring as shown in FIGS. 2 and 5 is trapped in the trough 95 between the inner surface 102 of the jaw and the bottom of the trough. The spring 94 urges the jaw to the position shown in full lines in FIG. 2 engaging the cam surface 90 of the jaw housing 44. A shallow recess 106 (see FIG. 11) may be provided in the inner surface 102 of the jaw 40 to receive arm 98 of the spring.

Figure 3:
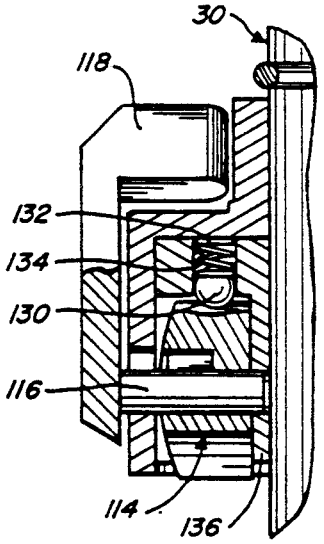
FIG. 3 is a fragmentary cross-sectional view of the ratchet assembly forming part of the output end of the wrench.
Figure 4:
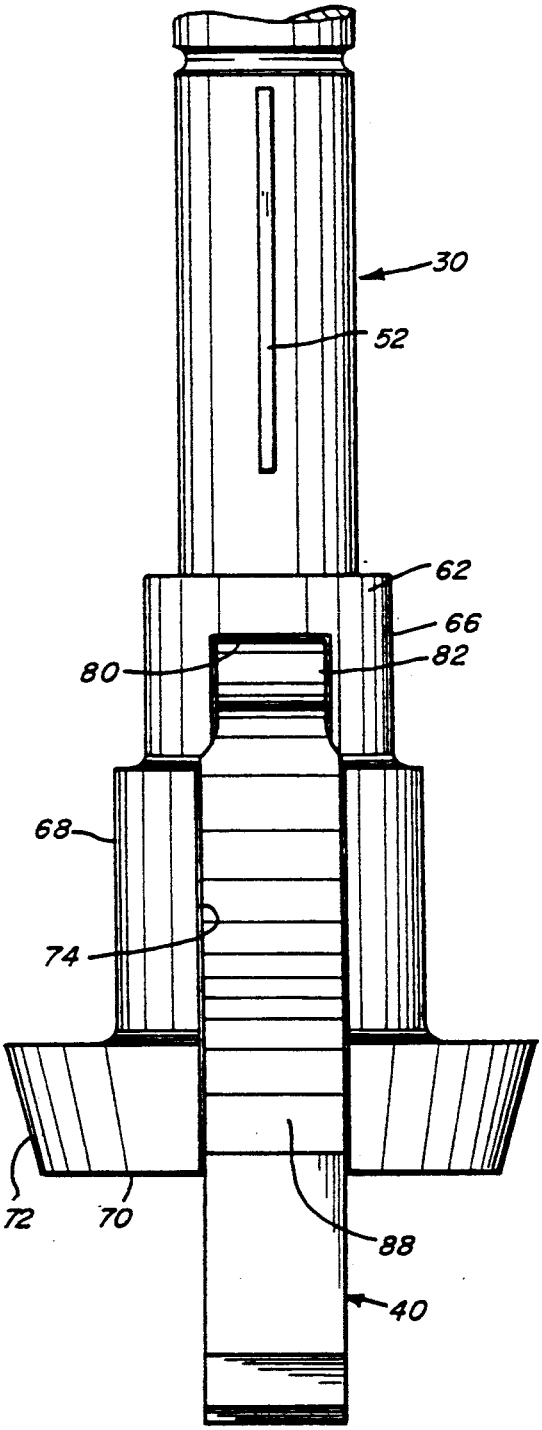
FIG. 4 is an enlarged detailed view of the jaw and shaft forming part of the assembly shown in 2.

As is evident in FIG. 2, the upper surface 110 of the jaw housing 44 is provided with a circular rack 112 which forms part of the ratchet assembly within ratchet housing 42. The ratchet assembly also includes a pawl 114 pivotally supported on a shaft 116 carried in turn by the ratchet control lever 118 (see also FIGS. 3 and 7). The pawl 114 may be moved between its two extreme positions by movement of the lever 118 from one to the other of the positions identified a "close" and "open" in FIG. 6. The pawl 114 has a lower arcuate surface 120 at each end of which are teeth 122 and 124 which selectively engage the rack 112 on the jaw housing depending upon the position of the ratchet control lever 118. As illustrated in FIGS. 3, 7 and 8, a ball detent 130 biased by spring 132 is mounted in a slot 134 in guide ring 136 of the ratchet assembly and engages the tooth 138 on the upper surface of pawl 114 to bias the pawl to the position selected by the lever 118. The manner in which the ratchet functions during use of the tool is explained in detail below in connection with the tool operation.

Because the jaws 40 are pivotally mounted at their upper ends by means of the cylindrical heads 82 and the wells which house them, the inner faces of the lower ends of the jaws do not remain parallel to the shaft axis for all jaw positions. For example, in the outer most position of the jaw 40 shown in full lines in FIG. 2, the face 150 is not parallel to the shaft axis and therefore the face would not bear square against the face of a nut or bolt head engaged by the jaws, and, therefore, the tool would not work efficiently to turn it. In order to compensate for the shift in the plane of the face 150 of each jaw by changes in its angular position, gripping pads 26 are mounted on the jaws, which are free to pivot on the jaws so as to provide surfaces parallel t the shaft axis for gripping the work piece. The details of the lower ends of the jaws and the gripper pads 26 are shown in FIGS. 12-23.

In FIGS. 16, 17 and 17A the lower end of each jaw on its inner surface 150 is shown provided with an arcuate face 200 of constant radius, and a pair of parallel rails 202 and 204 extend from the face 200 and are arranged generally vertically. Each rail 202 and 204 carries an outwardly extending flange 206, and the rails engage corresponding slots 210 and 212 in the outer arcuate face 214 of the gripping pad 216 shown in detail in FIGS. 19–22. The slots 210 and 212 extend to the very bottom of the pad and include an undercut 213 along their outer sides which receive the flanges 206 of the rails. The slots 202 and 206, however, as shown in FIGS. 19 and 21, terminate short of the upper edge 220 of the pad so as to define stops 222 at their upper ends.

To mount a pad 216 on the jaw face 200 to complete the jaw assembly, the lower ends of the slots 210 and 212 are aligned with the upper ends of the rails 202 and 204, and the pad is then rotated over the face 200 so that the rails thread into the slots until the stops 222 engage the upper ends of the rails. The stops thus limit the travel of the pad on the jaw face 200 in a clockwise direction as shown in FIG. 18.

In FIGS. 19, 22 and 23 it will be noted that a short vertically oriented slot 230 is formed on the center line of the rear surface 214 of the pad. A pin 232 mounted in the jaw extends into the slot 230 and limits the counterclockwise rotation of the pad 216 as viewed in FIG. 23. The pin, of course, is set in the jaw after the pad has been mounted on the rails, and the pin 232 will retain the pad on the jaw regardless of the orientation of the tool.

Figure 15:
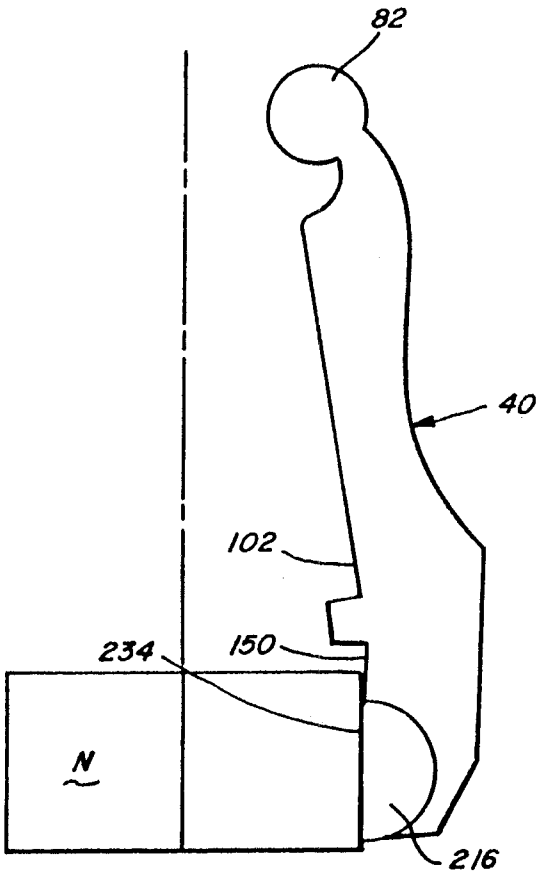
Figure 14:
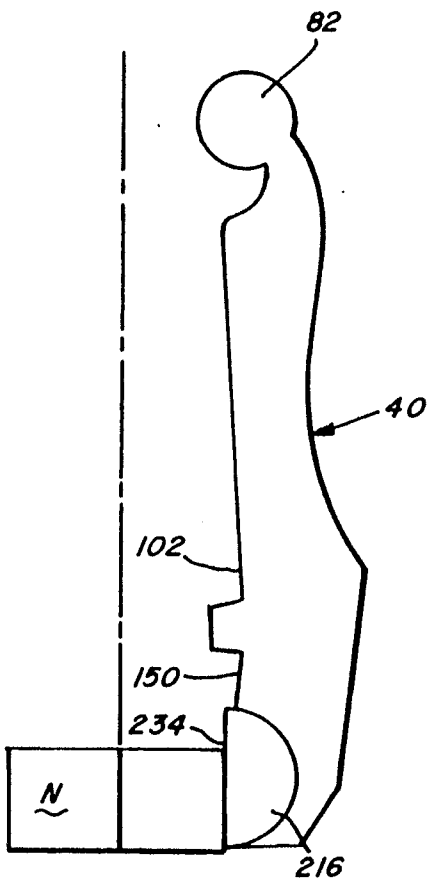
Figure 13:
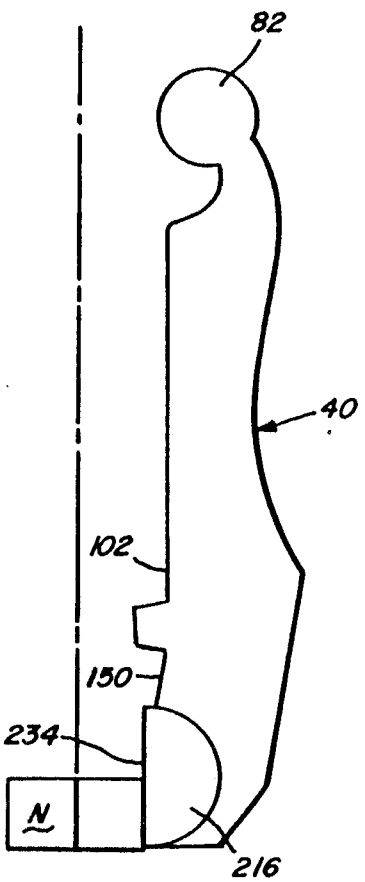
Figure 12:
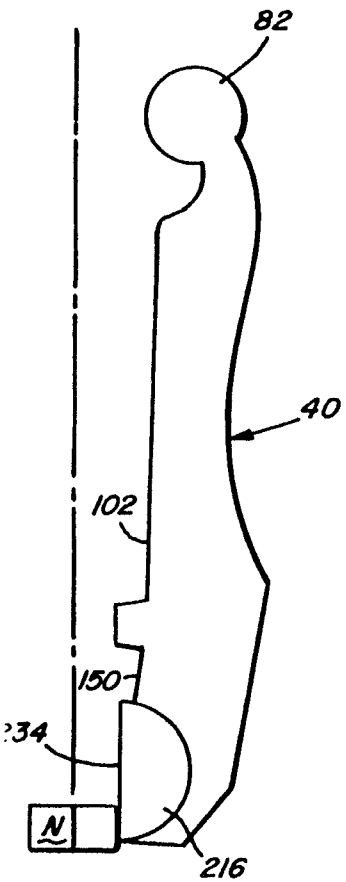

In FIGS. 12–15 which diagrammatically illustrate one jaw assembly, four different sizes of nuts N are shown, as well as the particular position assumed by pad 216 as it engages each nut size. The extreme positions of the pad 216 are shown in FIGS. 12 and 15 where the smallest and largest nuts are engaged by the jaw. In each of the four figures the gripping face 234 of the pad is disposed parallel to the axis of the nut, which is coincident with the shaft axis, and the pad is in position to make face to face contact with the flat of the nut.

Figure 1:
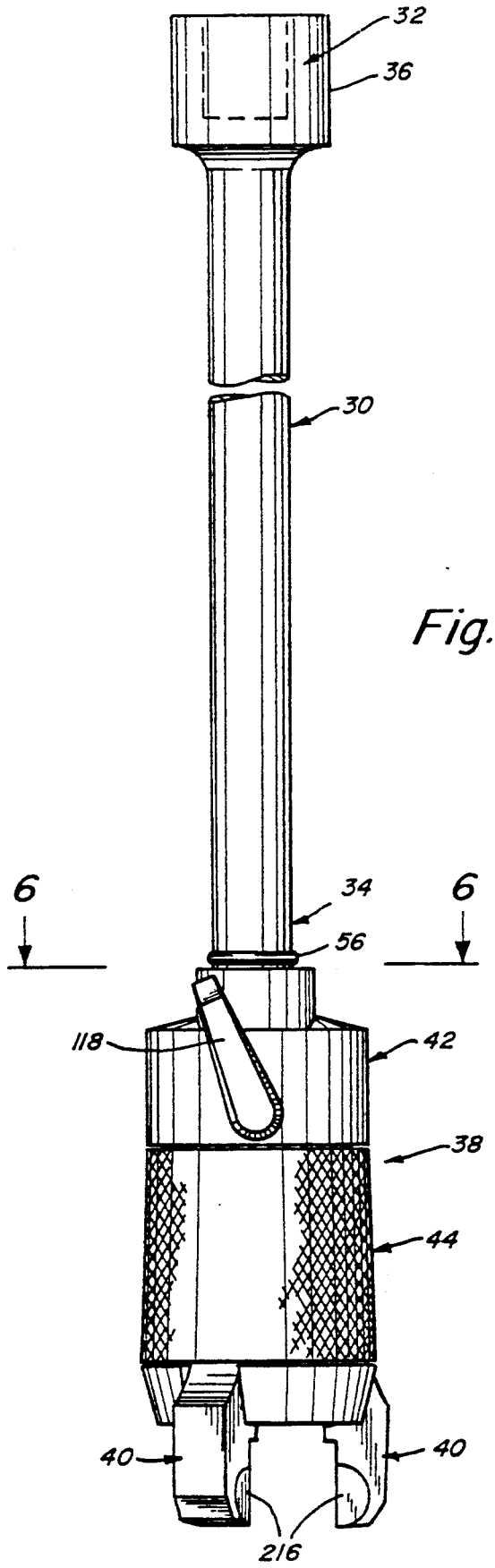
FIG. 1 is a side elevation view of an adjustable extension wrench constructed in accordance with my invention.

The adjustable wrench of the present invention operates as follows:

The adjustable extension wrench shown in FIG. 1 typically may be operated by a ratchet drive tool which is attached to the input end 32 of the shaft 30. For that purpose, the square drive fitting 36 is shown in FIG. 1. If the extension wrench is to be used to turn a nut onto a threaded member, the working head 38 of the tool is placed so that the jaws 40 face three of the flats of the nut. The control lever 118 is placed in the "close" position shown in FIGS. 1 and 6, which places the pawl 114 in the operative position shown in FIG. 2. In that position, the jaw housing 44 can be rotated clockwise as viewed in FIG. 6, and 11 which causes the cam surfaces 90 on the inside of the jaw housing 44 that bear against the outer surfaces 88 of the jaws, to move the jaws toward the nut. The faces 234 of the gripper pads 216 ultimately engage the flats of the nut as suggested in FIGS. 12–15. The gripper pads compensate for the angular disposition of the jaws 40 so as to insure that face to face contact is made with the flats. When the gripper pads 216 make firm contact with the flats of the nut, the jaw housing 44 will no longer turn in the clockwise direction and will automatically lock together against the nut. With the workpiece firmly engaged, the operator with the use of the ratchet wrench attached to the input end 32 of shaft 30, rotates the shaft, which causes the entire working head 38 of the tool to rotate and carry the nut with it. The ratchet handle used to turn the shaft 30 will, of course, allow the operator to back off so that only a portion of a revolution may be used if desired to advance the nut on the threaded member.

After the nut is tightened on the member, the operator may remove the tool from the nut by moving the control lever 118 to the "open" position, which reverses the position of pawl 114 with respect to the rack 112 on the upper surface of the jaw housing 44. In this position, the jaw housing 44 is free to rotate counterclockwise, thereby relieving the pressure exerted by the cam surfaces 90 on the outer surfaces of the jaws, and the Sear springs 94 bearing against the jaws will spread them so that the tool may be disengaged from the nut.

If the tool is to be used to loosen or unscrew the nut from a threaded workpiece, the procedure described above is again used to tighten the jaws against the flats of the nut with the control lever 118 in the "close" position. With the nut firmly engaged by the gripper pads 216 on the jaws, the ratchet handle used to rotate shaft 30 is turned counterclockwise. Obviously an appropriate adjustment must be made to the ratchet handle to cause the counterclockwise rotation of the handle to turn the shaft 30.

While in the foregoing the invention has been described in terms of an extension wrench, it is to be understood that the working head 38 of the tool may be used as part of a modular system as an adjustable ratchet wrench. This is illustrated in FIGS. 24–29 wherein a second embodiment of working head 38' is shown along with several extension bars, an adapter and two ratchet drives. In the FIG. 24 embodiment, the shaft 30 is replaced by a shorter shaft 300 as shown. The working head 38' is otherwise identical to that of the first embodiment. The shaft 300 which extends just beyond the retaining ring 56 may be engaged directly by the ratchet handle R of FIG. 29. Alternatively, the extension bar shown in FIG. 25 may be mounted on the shaft 300, which in turn is engaged by the ratchet handle R to rotate the head. As another alternative, the standard square drive ratchet wrench R' of FIG. 28 may be used to drive the head 38' either with the adaptor of FIG. 27 or the extension bar of FIG. 26. It will be noted that the wrench R of FIG. 29 has a socket 306 that will accept the shaft 300 of the head 38', and the extension bars of FIGS. 25 and 26 and the adapter of FIG. 27 have similar sockets 308, 310 and 312 to accept the shaft 300. The upper end of the extension bar of FIG. 25 in turn has an input shaft 314 which duplicates the shaft 300 and fits into socket 306, while the upper ends of the extension bar and adapter of FIGS. 26 and 27 have fittings 316 and 318, respectively to receive the square drive 320 of the standard wrench R'. Thus, the working head 38' of the tool may be used as an adjustable modular ratchet wrench with or without an extension.

Having described this invention in detail those skilled in the art will appreciate that numerous modifications may be made of this invention without departing from its spirit. Therefore, I do not intend to limit the breadth of this invention to the embodiments illustrated and described. Rather, it is intended that the scope of this invention be determined by the appended claims and their equivalents.

What is claimed is:

1. An adjustable wrench comprising;

a drive shaft having a longitudinal axis and an input and an output end, a ratchet housing keyed to the drive shaft for rotation therewith and open at one end facing in the direction of the output end of the shaft, a second housing mounted on and surrounding the shaft beyond said one end of the ratchet housing, said second housing being rotatable on and with respect to the shaft, pivot recesses formed by the second housing and the shaft, a plurality of jaws having pivot heads at one end pivotally mounted in the pivot recesses between the shaft and the second housing and having gripping pads at their opposite ends for engaging a work piece movable toward and away from the longitudinal axis of the shaft and positioned beyond the output end of the shaft and extending out of the second housing, springs engaging each of the jaws and biasing them away from one another, a plurality of cam surfaces formed on the second housing and engaging the jaws below the pivot heads for pivoting the jaws inwardly toward the axis against a workpiece when the second housing is rotated on the shaft in one direction, and a two position ratchet mechanism in the ratchet housing including a manually operated control lever, said mechanism in one position enabling the second housing to rotate in one direction with respect to the shaft to move the jaws toward the axis and in a second position enabling the second housing to rotate in the opposite direction to move the jaws away from the axis under the influence of the springs.

2. An adjustable wrench as set forth in claim 1 wherein the gripper pads have gripper faces, and means is provided for supporting the pads on the jaws enabling the pads to pivot with respect to the jaws to orient the gripper faces parallel to the shaft axis for different angular positions of the jaws.

3. An adjustable ratchet wrench as set forth in claim 1 wherein the ratchet mechanism includes a pawl mounted in the ratchet housing and a rack carried on the second housing, and a control means is connected to the pawl and extends out of the ratchet housing and carries the lever for enabling the user of the wrench to move the mechanism from one position to the other.

4. An adjustable wrench as set forth in claim 3 wherein the gripper pads have gripper faces, and means is provided for supporting the pads on the jaws enabling the pads to pivot with respect to the jaws to orient the gripper faces parallel to the shaft axis for different angular positions of the jaws.

5. An adjustable ratchet wrench as set forth in claim 2 wherein tracks and grooves on the jaws and gripper pads enable the pads to pivot on the jaws.

6. An adjustable ratchet wrench as set forth in claim 5 wherein the tracks are on the jaws and the grooves are on the pads.

7. An adjustable ratchet wrench as set forth in claim 2 wherein the input end of the shaft is adapted to receive a ratchet handle.

8. An adjustable ratchet wrench as set forth in claim 2 wherein the input end of the shaft is adapted to receive an extension bar.

9. An adjustable ratchet wrench as set forth in claim 1 wherein the input end of the shaft is adapted to receive a ratchet handle.

10. An adjustable ratchet wrench as set forth in claim 1 wherein the input end of the shaft is adapted to receive an extension bar.

11. An adjustable ratchet wrench as set forth in claim 1 wherein the shaft is integrally formed with an extension bar.

12. An adjustable wrench comprising:

a drive shaft having a longitudinal axis and an input and an output end, a housing mounted on and surrounding the shaft, said housing being rotatable on and with respect to the shaft, a plurality of jaws pivotally mounted at one end between the shaft and the housing and having gripping pads for engaging a work piece and positioned beyond the output end of the shaft, spring means engaging each of the jaws and urging them to pivot away from one another, a plurality of cam surfaces formed on the housing and engaging the jaws for pivoting the jaws inwardly toward the axis against a workpiece when the housing is rotated on the shaft in one direction and enabling the jaws to pivot away from one another under the influence of the spring means when the housing is rotated in the opposite direction, and means connected to the shaft and housing for selectively enabling the housing to turn in only one direction on the shaft, wherein the means connected to the shaft comprises a ratchet housing mounted on, fixed to and rotatable with the shaft, a pawl pivotally mounted in the ratchet housing between first and second positions, a circular rack on the first-recited housing and coaxial with the shaft, separate teeth provided on the pawl for engaging the circular rack when the pawl is in the first and second positions, one of the teeth preventing the first-recited housing from rotating on the shaft in one direction and the other of the teeth preventing said first-recited housing from rotating on the shaft in the opposite direction.

13. An adjustable wrench as defined in claim 12 wherein a control lever is connected to the pawl and extends out of the ratchet housing for moving the pawl to either of the two positions.

14. An adjustable ratchet wrench as set forth in claim 13 wherein the input end of the shaft is adapted to receive a ratchet handle.

15. An adjustable ratchet wrench as set forth in claim 13 wherein the input end of the shaft is adapted to receive an extension bar.

16. An adjustable ratchet wrench as set forth in claim 13 wherein the shaft is integrally formed with an extension bar.

* * * * *